US006565462B1

(12) United States Patent
Gregg

(10) Patent No.: US 6,565,462 B1
(45) Date of Patent: May 20, 2003

(54) PRACTICE BASEBALL BAT

(76) Inventor: Tommy Gregg, 420 New Haven Dr., Suwanee, GA (US) 30024

( * ) Notice: Subject to any disclaimer, the term of this patent is extended or adjusted under 35 U.S.C. 154(b) by 0 days.

(21) Appl. No.: 09/537,608

(22) Filed: Mar. 29, 2000

(51) Int. Cl.[7] ..... A63B 69/00; A63B 59/00; A63B 59/18; F41B 3/04

(52) U.S. Cl. ..... 473/457; 473/422; 473/564; 124/5

(58) Field of Search ..... D8/331; D21/725, D21/729; 124/5, 16, 36; 473/422, 424, 451, 457, 515, 425, 564–568, FOR 105; 273/109, 412, 330, 342

(56) References Cited

U.S. PATENT DOCUMENTS

| | | | | | |
|---|---|---|---|---|---|
| 1,018,866 | A | | 2/1912 | Blahos | |
| 1,325,813 | A | | 12/1919 | Taylor, Jr. | |
| 1,530,427 | A | | 3/1925 | Simon | |
| 2,237,748 | A | * | 4/1941 | Schwarzenzer | 273/109 |
| 3,111,314 | A | * | 11/1963 | Topper | 473/457 |
| 3,115,342 | A | | 12/1963 | Webster | |
| 3,120,387 | A | * | 2/1964 | Weinstein | 473/457 |
| 3,214,168 | A | | 10/1965 | Sauber | |
| 3,268,226 | A | | 8/1966 | Martino | |
| 3,376,037 | A | * | 4/1968 | Lepselter | 473/425 |
| 3,377,066 | A | | 4/1968 | Trowbridge | |
| 3,496,924 | A | * | 2/1970 | Miller | 124/5 |
| 3,729,196 | A | | 4/1973 | Heald, Jr. | |
| 3,807,213 | A | | 4/1974 | Willis et al. | |
| 4,177,989 | A | | 12/1979 | Easton et al. | |
| 4,521,015 | A | * | 6/1985 | Carafeno | 473/457 |
| 4,844,460 | A | | 7/1989 | Mitchell et al. | |
| 4,930,772 | A | | 6/1990 | Maloney et al. | |
| 5,024,435 | A | * | 6/1991 | Robbins | 473/457 |
| 5,421,572 | A | | 6/1995 | MacKay, Jr. | |
| 5,964,673 | A | | 10/1999 | MacKay, Jr. | |
| D427,880 | S | * | 7/2000 | Sombatjirakal | D8/331 |
| D429,456 | S | * | 8/2000 | Chen | D8/331 |

* cited by examiner

*Primary Examiner*—Paul T. Sewell
*Assistant Examiner*—Mihra Aryanpour
(74) *Attorney, Agent, or Firm*—Baker, Donelson, Bearman & Caldwell

(57) ABSTRACT

A practice baseball bat for assisting the development of a batter's swing mechanics and techniques, comprising a conventional baseball bat defined by an elongate circular cross-sectional member with an improvement therein in which a portion thereof centered about a sweet spot of the member defines a recessed hitting surface having opposing shoulders extending between an exterior surface of the bat to the recessed hitting surface, whereby impacting the hitting surface on a thrown baseball causes the ball to fly away in a preferred flight such that repetitive use of the practice baseball bat develops muscle, stance, and swing mechanics and techniques in the batter for improving the batter's hitting skills.

13 Claims, 2 Drawing Sheets

PRACTICE BASEBALL BAT

TECHNICAL FIELD

The present invention relates to baseball bats. More particularly, the present invention relates to practice baseball bats for teaching baseball players proper stance and swing mechanics with visual feedback for developing proper hitting skills.

BACKGROUND OF THE INVENTION

Baseball and softball are team participation sports enjoyed by many individuals with wide variations in skills. Organized baseball leagues are provided for children as well as adults. These leagues include amateur play as well as professional. The amateur leagues are primarily directed to children's participatory leagues, but it also includes high school, college, and post-graduate amateur leagues for participants unable to compete in the professional leagues.

Baseball is a game of developed skills involving the throwing of a baseball, catching the baseball, and hitting the baseball with a baseball bat. Baseball games are competitive events between two teams. Prior to games, however, skills are developed through coaching and training in practice sessions. Coaches who typically are experienced players, teach other players how to develop the skills required for the game. While each of the positions on the team have differing skill requirements, each member of the team becomes involved in the hitting aspect of the game (except generally for pitchers in the professional American League).

The ability to hit a baseball with a bat involves the batter taking a standing position at the plate with the bat held in a rearward cocked position. The batter must swing the bat from the laterally rearward cocked position, through a frontal hitting position, and to a follow-through laterally forward position. The bat is swung at an appropriate time after the pitcher facing the batter has thrown the ball towards the plate where the batter is standing. At the appropriate time, the batter commences the swing. The swing is based on the batter making the necessary eye and arm coordination for swinging the bat at the appropriate time in view of the perceived travel of the baseball towards the plate. The batter must take into account the speed of the ball, the type of pitch and the expected flight path to the plate. Ideally, the bat impacts the baseball and causes the ball to travel outwardly from the plate into the baseball field, or preferably beyond.

Hitting a baseball with a baseball bat is a developed skill. Batters are considered successful when they have a hitting percentage of between about 0.250 and 0.333 or more. In other words, a batter is considered successful if a hit is obtained between one-fourth and one-third of the number of times the batter is at bat. In addition to batting average, some batters become skillful at hitting grounders which are balls that are hit downwardly to bounce on the ground and through the infield. Other batters become adept at hitting long flies to the outfield. Further, batters may develop skills for hitting the ball in particular pitches to selected parts of the ballfield, in order to advance base runners.

Because hitting is a developed skill, batting practice typically involves the batter standing at the batters box and swinging at a number of pitches. Pitching machines have been developed to throw baseballs towards the plate in order to give the batter repetitive opportunities to swing a baseball bat at a significant number of balls thrown over a period of time. Coaches observe the batter's stance, swing, and follow-through mechanics, and provide guidance as to changes the batter may make in order to be more successful at hitting.

In addition to using conventional baseball bats for practice, others have provided special practice baseball bats. One such bat includes an elongated opening that starts approximately two-thirds the length of the bat from the handle. The opening is dimensioned to give clearance to a standard baseball along an imaginary line through the center of the bat. This center portion is typically referred to as the sweet spot, in that baseballs hit at the center location are best driven by the batter into the playing field. Balls hit on an upper portion of the bat tend to pop-up, while balls hit on a lower portion of the bat tend to be driven into the ground as grounders for fielding by an infielder. In this practice bat, a net is provided outwardly of the backside of the bat. The bat catches the ball within the opening and the ball passes through the bat into the net. The bottom of the net is open allowing for the ball to drop to the ground. Another practice bat provides a hollow end for receiving baseballs with an opening for ejecting a ball. The ball is ejected by flipping the bat upwardly to toss a ball through the opening into the air. The batter then swings the bat in order to hit the ball into the playing field.

While these practice bats provide practice in hitting, there are drawbacks to their use. The bat with the net does not provide a true indication as to the performance of the batter when he has successfully swung the bat in that the ball is caught by the net backwardly of the bat rather than being directed into the playing field. The magazine-style practice bat requires frequent reloading. The balance, weight, and performance of this bat is not as a conventional baseball bat, so this practice bat does not provide a true representation of the swinging mechanics for a baseball bat.

Accordingly, there is a need in the art for an improved practice bat for learning swing mechanics for hitting thrown baseballs. It is to such that the present invention is directed.

BRIEF SUMMARY OF THE PRESENT INVENTION

The present invention meets the need in the art by providing an improved practice baseball bat for assisting batters to learn proper swing mechanics for hitting thrown baseballs. The practice baseball bat for assisting batters comprises an elongate member having a handle end that tapers into a barrel portion and terminates in an opposing distal end. The handle end and a substantial portion of the barrel are circular in cross-sections. An impact portion of the barrel defines a notch having a planar hitting surface recessed from an exterior surface of the barrel. The hitting surface provides a preferred portion for impacting a thrown baseball with the success of hitting being observable by the carry flight of the baseball into the playing field.

Objects, advantages and features of the present invention will become apparent from a reading of the following detailed description of the invention and claims in view of the appended drawings.

DETAILED DESCRIPTION OF THE PREFERRED EMBODIMENTS

Figure 1:
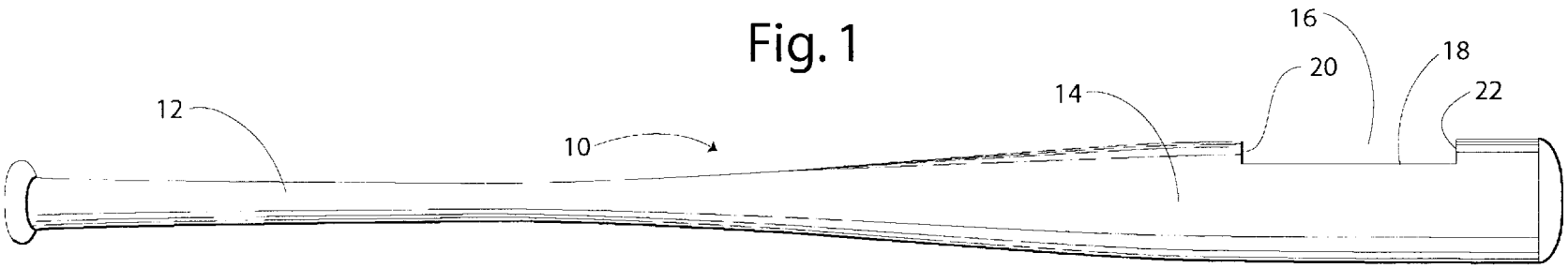
FIG. 1 is a horizontal side elevational view of the practice bat, according to the present invention.
Figure 2:
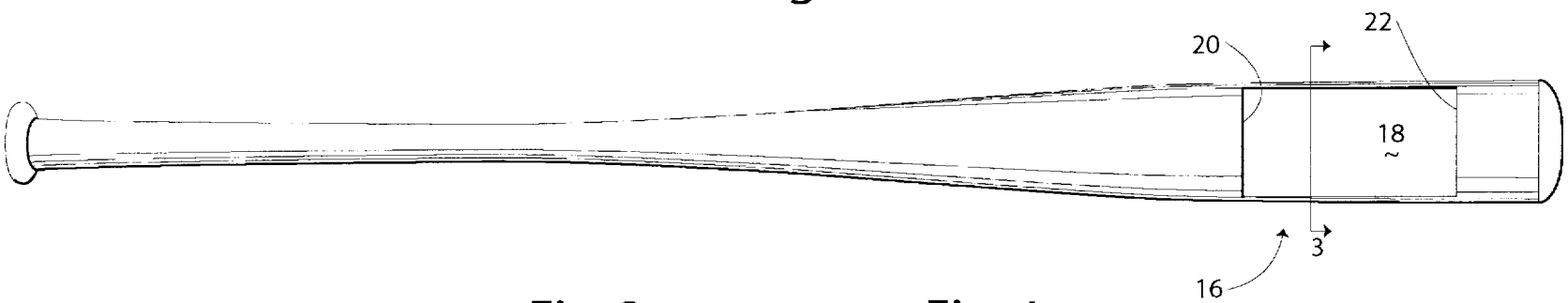
FIG. 2 is a horizontal front elevational view of the bat shown in FIG. 1.

Referring now in more detail to the drawings in which like parts have like identifiers, FIG. 1 is a horizontal side elevational view of a practice bat 10 according to the present invention. The bat 10 is a conventional elongate cylindrical body having a handle end generally 12 and a barrel generally 14 for impacting a baseball. As illustrated in FIG. 2, an elongated notch 16 is defined starting approximately two-thirds down the length of the bat 10 from the handle 12. The notch 16 defines an impact face 18 that is parallel to a longitudinal axis of the bat 10. The impact face 18 in the notch 16 is recessed from an exterior surface of the bat 10. The notch 16 defines two opposing shoulders 20 and 22.

Figure 4:
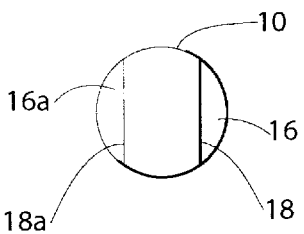
FIG. 4 is a horizontal side elevational view of an alternate embodiment of the practice bat of the present invention.
Figure 3:
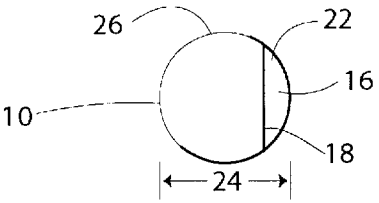
FIG. 3 is a cross-sectional view taken along line 3—3 of FIG. 2 to illustrate the notch in the practice bat of the present invention.

As best illustrated in FIG. 3, the notch 16 is recessed approximately one-third of the diameter 24 of the barrel of the bat 10. The length of the notch 16 is approximately two and one half baseball diameters. The notch 16 is preferably centered on the sweet spot of the bat from which most effective hits are obtained when the batter connects squarely with a ball. With the notch 16 configured in a wooden bat, the notch is disposed on a side perpendicular to the bat label 26. FIG. 4 is a cross-sectional view of an alternate embodiment of the practice bat 10, in which the barrel defines opposing notches 16 and 16*a*.

The practice bat 10 of the present invention may be manufactured using a conventional wood bat or an aluminum or metal bat. In the wooden bat, the notch 16 is preferably formed in a side lateral and perpendicular to the label 26 of the bat. The label 26 conventionally designates an "up" position relative to the ground, so as to reduce bat breakage. The notch 16 is cut with a band saw or by a saw operated to cut a mortise in the wood. The bat also can be manufactured in metal from metal tube stock which has been worked or machined, such as by swaging or ironing, to establish a relatively small diameter handle portion, a relatively large diameter barrel and a tapered intermediate portion. The notch 16 is formed by a die press or other swaging effort.

Figure 5:
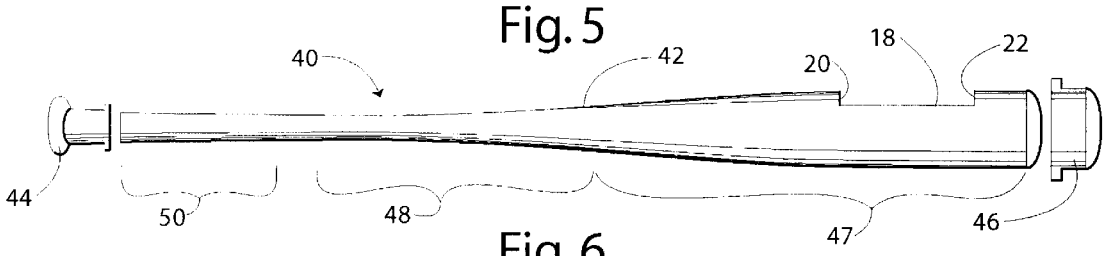
FIG. 5 is an exploded side elevational view of a practice bat having a metal body according to the present invention.

In particular reference to a hollow metal bat 40 of the present invention illustrated in FIG. 5, it is noted that such bats conventionally comprise a hollow metal casing 42, an end closure plug 44, and a handle grip and end closure member 46. The end plugs 44 and 46 typically comprise molded members formed of a light weight, shock resistant material, such as rubber, a poly vinyl chloride plastic, polyurethane, or other such material. The plug 44 inserts into the larger end of the casing 42, and the handle grip 46 is received at the smaller end of the casing 42 to assemble these elements together. The metal casing 42 is preferably formed from an extruded aluminum tube of uniform diameter and uniform wall thickness throughout. The tube 42 is swaged or ironed to reduce its diameter at one end, to form a bat body having outer barrel portion 47 with the diameter of the original tube 42, a tapering intermediate section 48, and a handle portion 50 of considerably less diameter than the original tube. This machining provides a bat body or casing 42 of approximately conventional bat shape. The casing 42 then is machined to define the recessed hitting surface 18.

In one method, the recess is defined by a hydraulic die press. A die supports the casing 42, and a movable die is forced, preferably under hydraulic pressure, against the casing. This defines the hitting surface 18 recessed from the exterior surface with opposing shoulders 20 and 22.

Figure 6:
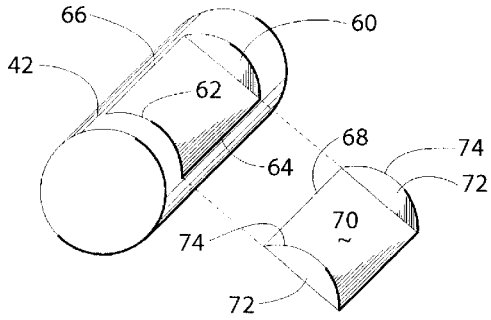
FIG. 6 is an exploded perspective view of a portion of the practice bat illustrated in FIG. 5 illustrating the manufacture of the practice bat.

FIG. 6 illustrates an exploded perspective view of a metal practice bat made by a second method. A portion of the casing 42 is cut along parallel lines 60, 62 to define the ends of a notch. The cuts are approximately one-third to one-half the diameter of the casing 42. Two cuts 64, 66 are made parallel to a longitudinal axis of the casing 42 between the opposing distal edges of the cuts 60, 62. This severs a portion of the casing 42. The hitting surface 18 is defined as an insert 68 having a planar member 70 with a pair of opposing flanges 72 at distal ends. Distal edges 74 of the flanges 72 define an arcuate edge conforming to the curved exterior of the casing 42. The insert 68 is received inwardly of the casing 42 through the opened side. The insert 68 is welded in place to define the notch 16 with the hitting surface 18.

Returning to FIG. 5, in assembling the plugs 44, 46 with the casing 42, a skirt end inserts into the respective open end of the barrel with the plug being slightly compressed to permit entry of the plug within the annular opening. The skirt end may include a lip that engages a groove on an interior surface of the barrel. Adhesive may also be used to secure the plugs 44 and 46 to the casing 42. Prior to closing the ends of the casing, wadding such as cellulose fibers is conventionally packed within the interior to absorb sound and shock.

Figure 7:
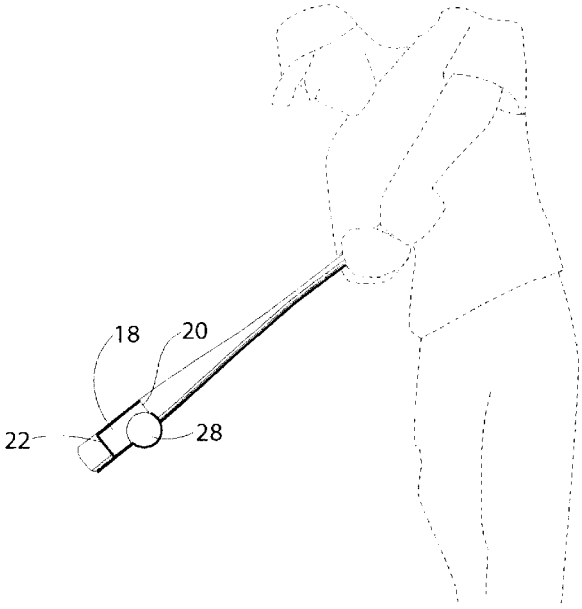
FIG. 7 is a illustration of the practice bat of the present invention being used for learning how to swing the bat at a thrown baseball.

The practice bat 10 is operated preferably with the instruction of a coach for guiding the batter in developing proper batting stance and mechanical swing skills, while also developing eye and arm coordination in evaluating the speed and travel of the thrown baseball from a pitcher for impacting the surface 18 in the barrel of the bat 10 squarely with the ball. Preferably, the batter's hands grip the handle portion with correct positioning. As the batter swings, the hands go through the swing and the follow through, without rolling over. A batter whose hands "roll-over" downwardly tends to hit soft grounders while a batter whose hands "roll-over" upwardly tends to hit pop-ups, and both are generally easily fielded for outs. With the present invention, the batter learns to go through or swing through the ball during the pitch while the bat impacts the ball in the sweet spot. The batter learns the swing mechanics whereby the sweet spot is brought into impacting engagement with the thrown pitch. With reference to FIG. 7, a baseball 28 is illustrated as impacting a comer portion of the face 18 which should result in a solid line drive into an outfield portion of the baseball field.

The practice bat 10 of the present invention provides an immediate visual indication to the batter as to the impact position of the ball 28 on the bat 10. The ball will fly outwardly and laterally away from the batter when the ball impacts the inner shoulder 20. The ball will fly outwardly and laterally in a direction substantially towards the batter when the ball impacts on the outer shoulder 22. When the ball 28 impacts a bottom surface of the bat, the ball will be driven down to the ground. When the ball 28 impacts an upper edge of the bat 10, the ball will pop-up and possibly rearwardly away from the batter.

It is thus seen that the present invention as disclosed here and provides a practice bat for developing the stance and swing mechanics of batters while the batter is coordinating eye and arm actions with a thrown baseball, in order to learn how to hit a baseball thrown by a pitcher. While this invention has been described in detail with particular reference to the preferred embodiments thereof, the principles and modes of operation of the present invention have been described in the foregoing specification. The invention is not to be construed as limited to the particular forms disclosed because these are regarded as a lustrative rather than restrictive. Moreover, modifications, variations and changes may be made by those skilled in the art without departure from the spirit and scope of the invention as described by the following claims.

What is claimed is:

1. A practice baseball bat for assisting batters to learn proper mechanics and techniques for hitting a thrown baseball, comprising:

an elongate member having a handle end that tapers into a barrel portion and terminates in an opposing distal end;

the handle end and a substantial portion of the barrel being circular in cross-sections; and an impact portion of the barrel having a planar hitting surface exposed by a notch and recessed from an exterior surface of the barrel, whereby the hitting surface provides a preferred portion for impacting a thrown baseball with the success of same observable by the carry flight of the baseball into the playing field.

2. The practice baseball bat as recited in claim 1, wherein the hitting surface is substantially parallel to a longitudinal axis of the elongate member.

3. The practice baseball bat as recited in claim 1, wherein the notch defines a pair of opposing shoulders extending between the exterior surface and the hitting surface.

4. The practice baseball bat as recited in claim 1, wherein the hitting surface is recessed to a depth of about one-third of the diameter of the barrel portion.

5. The practice baseball bat as recited in claim 1, wherein the elongate member is wooden.

6. The practice baseball bat as recited in claim 1, wherein the elongate member is aluminum.

7. The practice baseball bat as recited in claim 1, wherein the hitting surface is centered on a sweet spot portion of the elongate member.

8. A practice baseball bat for assisting the development of a batter's swing mechanics and techniques, comprising a conventional baseball bat defined by an elongate circular cross-sectional member with an improvement therein in which a portion thereof centered about a sweet spot of the member defines a recessed planar hitting surface exposed by a notch having opposing shoulders extending between an exterior surface of the bat to the recessed hitting surface, whereby impacting the hitting surface on a thrown baseball causes the ball to fly away in a preferred flight such that repetitive use of the practice baseball bat develops muscle, stance, and swing mechanics and techniques in the batter for improving the batter's hitting skills.

9. The practice baseball bat as recited in claim 8, wherein the hitting surface is substantially parallel to a longitudinal axis of the elongate member.

10. The practice baseball bat as recited in claim 8, wherein the hitting surface is recessed to a depth of about one-third of the diameter of the elongate member at a central point of the hitting surface.

11. The practice baseball bat as recited in claim 8, wherein the elongate member is wooden.

12. The practice baseball bat as recited in claim 8, wherein the elongate member is aluminum.

13. The practice bat as recited in claim 12, further comprising an insert having a planar member with flanges at opposing ends securely engaged to a receiving cut-out in a portion of the barrel.

* * * * *